US005787689A

United States Patent [19]

Dearing

[11] Patent Number: 5,787,689

[45] Date of Patent: Aug. 4, 1998

[54] BAG DISCHARGE CONSTRICTION APPARATUS AND METHOD FOR CONSTRICTION CONTROL

[75] Inventor: Robert Dearing, Lancashire, England

[73] Assignee: Spiroflow-Orthos Systems, Inc., Monroe, N.C.

[21] Appl. No.: 674,206

[22] Filed: Jul. 1, 1996

[30] Foreign Application Priority Data

Jul. 5, 1995 [GB] United Kingdom ..... 9513685

[51] Int. Cl.[6] ..... B65B 43/26

[52] U.S. Cl. ..... 53/492; 53/390; 53/384.1; 24/457; 24/424; 24/568

[58] Field of Search ..... 53/390, 410, 512, 53/492, 416, 384.1, 133.4, 139.2; 24/457, 271, 21, 484, 568; 222/504, 181.2; 251/7

[56] References Cited

U.S. PATENT DOCUMENTS

| | | | |
|---|---|---|---|
| 3,550,353 | 12/1970 | Haadsma | 53/390 |
| 3,699,745 | 10/1972 | Reid | 53/512 |
| 4,479,344 | 10/1984 | Edwards | 53/390 |
| 4,520,534 | 6/1985 | De Lima Castro Netto . | |
| 4,534,149 | 8/1985 | Hoyland . | |
| 5,322,195 | 6/1994 | Ellis | 222/502 |
| 5,442,898 | 8/1995 | Gabree et al. . | |

FOREIGN PATENT DOCUMENTS

| | | | |
|---|---|---|---|
| 546518 | 6/1973 | U.S.S.R. | 53/416 |

*Primary Examiner*—John Sipos
*Assistant Examiner*—Gene L. Kim
*Attorney, Agent, or Firm*—Kennedy Covington Lobdell & Hickman, L.L.P.

[57] ABSTRACT

A bag discharge constriction apparatus and method are disclosed in which the extent to which an opening in a bag is constricted is adjustably varied to control the discharge of material from the bag. The apparatus has a first control bar and a second control bar, each defining at least one angular relationship in a corresponding plane. Also disclosed is a means for moving at least one control bar in its associated plane toward and away from the other control bar. The control bars are disposed in opposing configuration such that the combination of the angular relationships forms a predetermined confined shape between the control bars. It is into this predetermined confined shape that the neck of the bag to be constricted is placed and the bars are then moved toward or away from each other to constrict or open the neck of the bag. As the control bars are moved toward or away from each other, the predetermined confined shape changes only in area and evenly exerts force upon all sides of the neck of the bag, thus minimizing tearing stresses.

21 Claims, 5 Drawing Sheets

BAG DISCHARGE CONSTRICTION APPARATUS AND METHOD FOR CONSTRICTION CONTROL

BACKGROUND OF THE INVENTION

The present invention relates to discharge of material from a bag or similar container and, more particularly, to a bag discharge constriction apparatus and method for adjustably varying the extent to which an opening in a bag is constricted to control the discharge of material from the bag.

Bags and similar containers are often used in industry as a combination of packaging and a lifting system which can be used in the transportation of granular and powder materials in a wide variety of circumstances. For example, a flexible intermediate bulk container (FIBC) is such a bag that is a flexible container having a capacity of not more than three cubic meters and/or a gross mass when filled of not more than 3,000 kilograms that is designed to be lifted from above by integral or detachable devices. Some such bags are designed and intended to be used for one filling and one discharge; however, some such bags are intended to be used for more than one filling and more than one discharge.

After such bag is filled, normally the bag is sealed, as by tying, to ensure that the material within does not spill out in an unwanted manner. When such a bag is to be emptied, often it is suspended and the discharge neck of the bag is untied, allowing the material within to flow out of the now open neck. With some types of bags that are designed for single use, the neck may simply be cut, allowing the entire contents to discharge. However, if it is desired not to discharge the entire contents of a bag, or if the bag is to be reused at some later date, it is desirable to be able to control the flow of material from such a bag or other container and to be able to re-tie the bag after the desired quantity of contents has been discharged.

The most common apparatus for use in controlling the flow of material from a container has been the use of opposed parallel bars which are urged together to compress the neck of the container. The use of parallel bars to so restrict the discharge of material from a container is problematical in several ways, particularly in that the bars cannot effect a complete seal in the case of a relatively incompressible material being contained in the container, and as a result material is wasted by leakage from the ineffectively sealed container. Also, material is unnecessarily crushed between these parallel bars in an attempt to seal the container. If the material contained within the container is the subject of environmental concerns, then leakage of such dangerous material into the environment is extremely undesirable for health and safety reasons. Further, the parallel bars can only provide a flat double layer of the container when closed; this may be a problem if it is desired to retie the container.

Further, the use of such parallel bars which are urged together to compress the neck of the container often results in uneven and shear stresses applied to the neck of the container, which may lead to tearing of the container. Obviously, this is undesirable in that the discharge of material from the container may no longer be controlled, nor may the container be reused.

SUMMARY OF THE INVENTION

It is an object of the present invention to provide a bag discharge constriction apparatus and method to adjustably vary the extent to which an opening in a bag is constricted to control the discharge of material from the bag. It is a further object of the present invention to constrict the opening in a bag in such a manner that the bag may be easily retied. It is a further object of the present invention to adjustably vary the opening in a bag by exerting evenly displaced stresses upon the neck of the bag to minimize the possibility of tearing of the bag. It is a further object of the present invention to provide a bag discharge constriction apparatus and method that effects a complete seal when the material within the bag is relatively incompressible and does not unnecessarily crush material within the bag in an attempt to seal the container.

The present invention is a bag discharge constriction apparatus and method for adjustably varying the extent to which an opening in a bag is constricted to control the discharge of material from the bag. The apparatus includes a first control bar and a second control bar, each defining at least one angular relationship in a corresponding plane and disposed in opposed relation so that they cooperate to form a predetermined confined shape therebetween. The planes in which the control bars lie are essentially parallel to each other. The apparatus also includes means for moving at least one control bar in its associated plane toward and away from the other control bar. In another embodiment, a third control bar is parallel to and spaced from the second control bar with the first control bar disposed between and opposed to the second and the third control bars.

The apparatus further includes guidance means to ensure that the movement of the control bars is essentially within the planes in which the control bars lie. In one embodiment, a bar segment is joined at each extending end of each control bar in substantially the same plane as the control bar and extending outwardly therefrom in a direction essentially parallel to the direction of movement of the control bar. At the end of each bar segment, a guide pin is attached to the bar segment to extend substantially perpendicularly outwardly from the bar segment and is disposed in essentially the same plane as the control bar to which the bar segment and guide pin are attached. Further, two parallel guide bars are disposed exteriorly of the control bars and are arranged to extend substantially parallel to each other. Each guide bar is disposed on opposite sides of the control bars, and the guide pins on the control bar segments are disposed for sliding movement in slots found in the guide bars such that the movement of the control bars is substantially confined to the planes parallel to those in which the control bars lie by the movement of the guide pins along the slots.

The neck of a bag to be constricted is placed within the confined opening having a predetermined shape between the control bars, and the control bars then engage the neck and are moved toward or away from each other to control the discharge of material from within the bag. As the control bars are moved toward or away from each other, the confined shape does not change, but varies in area, and the amount of material being discharged from the bag is increased or decreased. When the control bars are moved together such that discharge of material from within the bag ceases, the neck of the bag is sufficiently gathered to be able to be retied to seal any remaining material within the bag. This method of controlling the discharge of material from within the bag produces less tearing stresses than does the conventional method of bringing two parallel bars together to pinch the neck of the bag.

DETAILED DESCRIPTION OF THE PREFERRED EMBODIMENT

Figure 1:
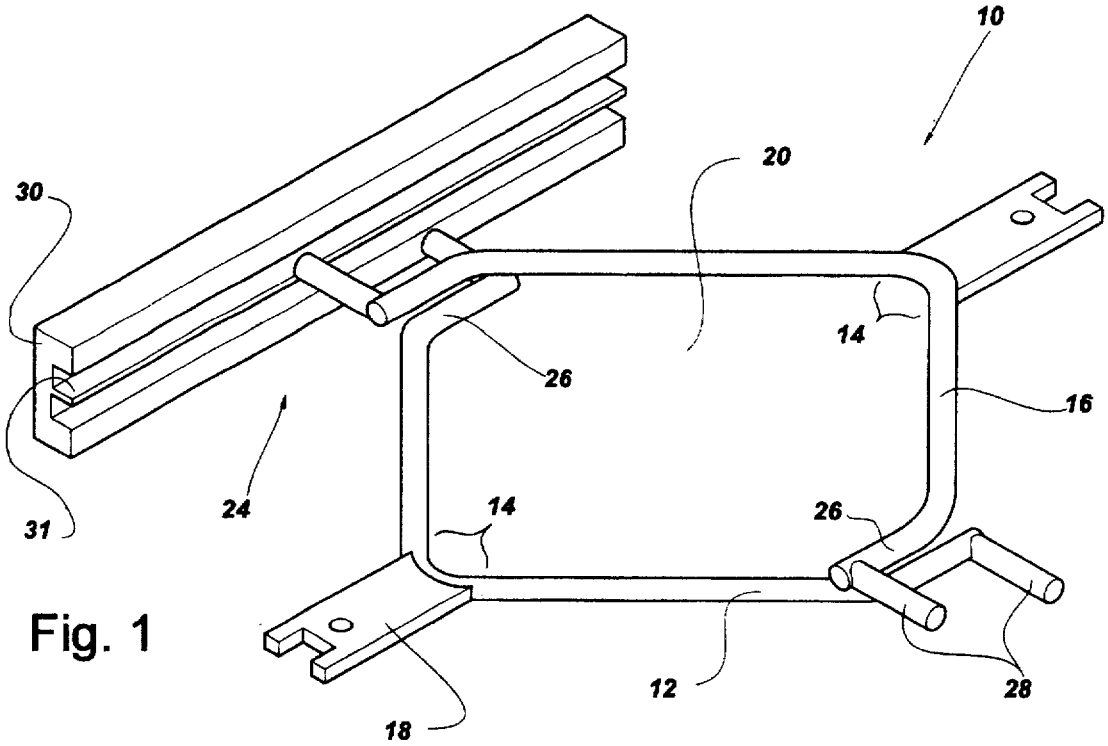
FIG. 1 is a perspective view of a bag discharge constriction apparatus according to one embodiment of the present invention.

FIG. 1 illustrates the bag discharge constriction apparatus 10 of the present invention. The apparatus 10 has a first control bar 12 defining at least one angular relationship 14 in a first plane, and a second control bar 16 defining at least one angular relationship 14 in a second plane. The first plane is essentially parallel to the second plane. The apparatus 10 further includes a bracket 18 which is attached to each control bar 12,16 and arranged to be connected to any conventional drive arrangement (not shown) for moving at least one control bar 12,16 in its associated plane toward and away from the other control bar 12,16.

Figure 2:
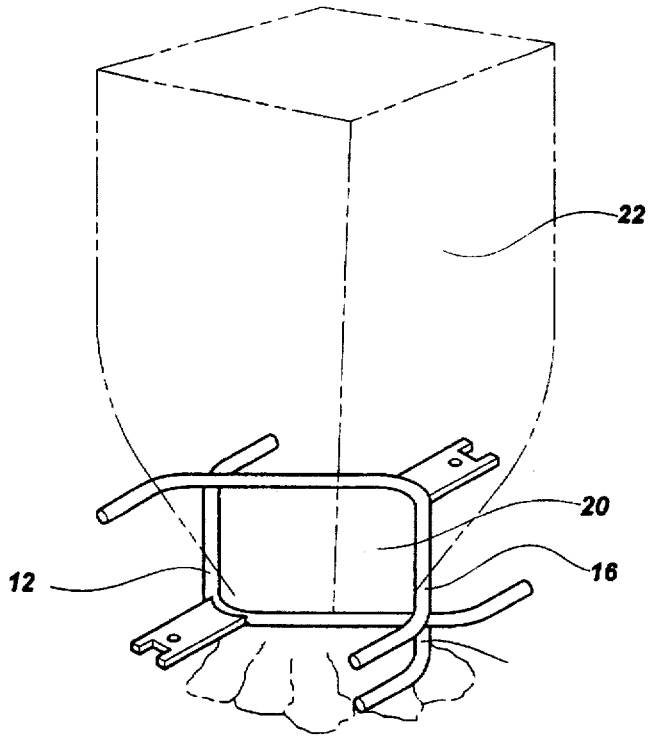
FIG. 2 is a perspective view of the bag discharge constriction apparatus of FIG. 1, illustrating the placement of a bag from which the discharge of material is to be controlled.

The first control bar 12 and the second control bar 16 are disposed in an opposed configuration such that they cooperate to establish an opening 20 therebetween having a predetermined shape, preferably a rectangular shape as illustrated in FIG. 1. As illustrated by FIG. 2, it is into this opening 20 that the neck of a bag 22 from which the discharge of material is to be controlled is placed.

Preferably, the apparatus 10 further includes a guidance device 24 to control the movement of the control bars 12,16 so that it is maintained essentially within the planes in which the control bars 12,16 are located. The guidance device 24 includes a bar segment 26 at each extending end of each control bar 12,16 and extending outwardly therefrom in a direction essentially parallel to the direction of the movement of the control bar 12,16. As best illustrated in FIG. 1, the bar segments 26 are essentially parallel to each other at each end of each control bar and are in substantially the same plane as the control bar to which the bar segment 26 is joined.

Figure 4:
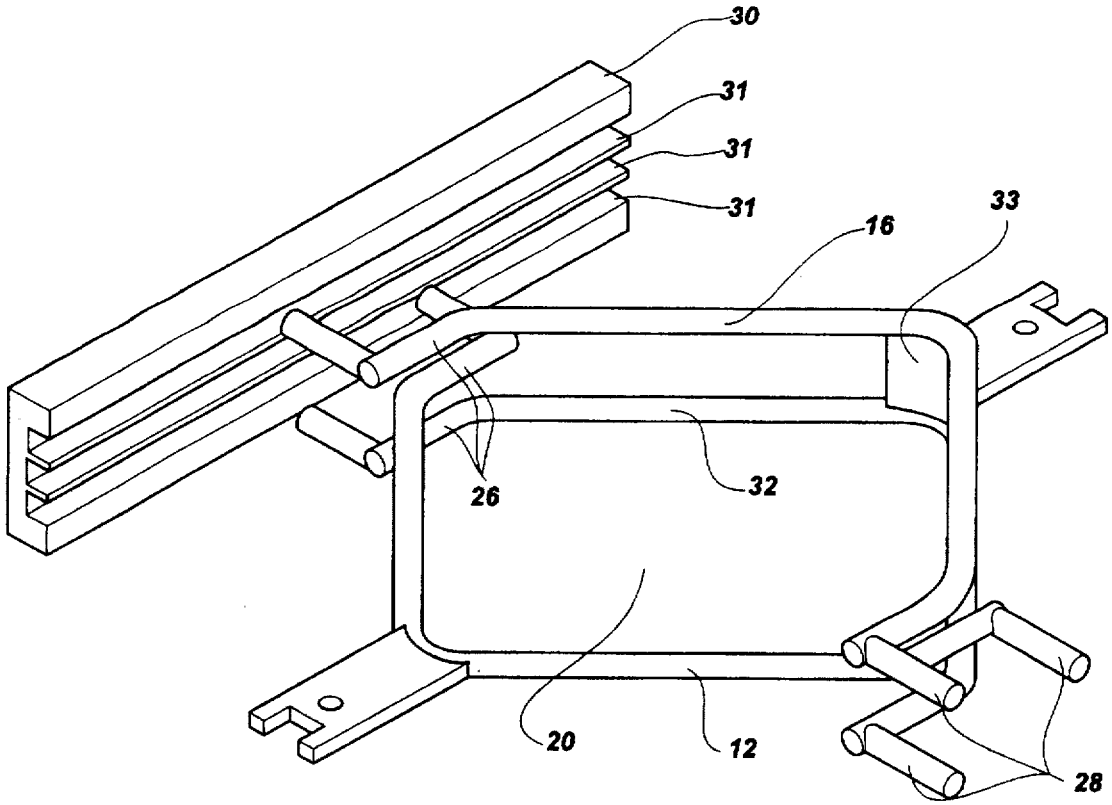
FIG. 4 is a perspective view of a bag discharge constriction apparatus according to another embodiment of the present invention which uses the control bars.
Figure 6:
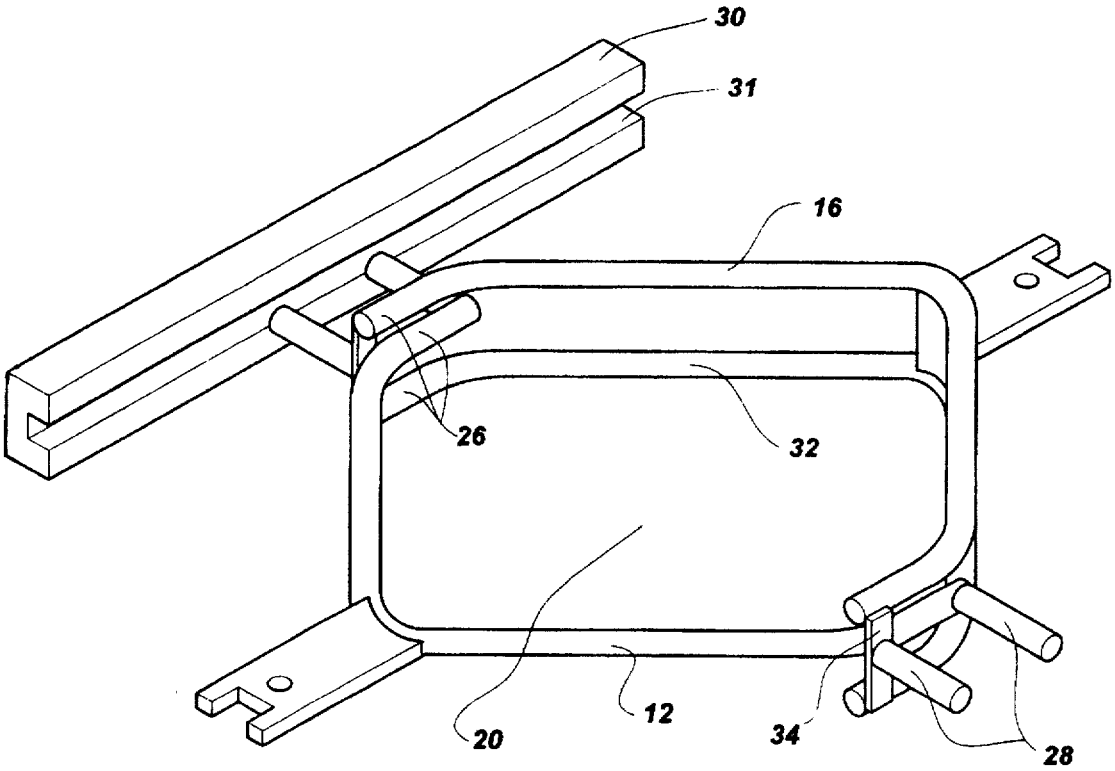
FIG. 6 is a perspective view of a bag discharge constriction apparatus according to still another embodiment of the present invention.

The guidance device 24 includes a guide pin 28 attached to bar segments 26 and disposed to extend substantially perpendicularly outwardly therefrom in substantially the same plane as the control bar to which the guide pin 28 is attached. The guidance device 24 also includes two parallel guide bars 30 (only one set of which is illustrated in FIGS. 1, 4, and 6) disposed exteriorly to the first control bar 12 and the second control bar 16 and arranged to extend substantially parallel to each other. Each guide bar 30 is disposed on opposite sides of the controls bars 12,16, with the guide pins 28 disposed for sliding movement in slots 31 formed in the guide bars 30 such that movement of the control bars 12,16 is controlled to remain substantially within the planes within which the control bars 12,16 lie by movement of the guide pins 28 along the slots 31.

When the neck of the bag 22 is placed within the opening 20 and the opposed control bars 12,16 are moved toward each other, they engage the neck of the bag 22 and begin to close the neck of the bag 22 so that the discharge of material from within the bag 22 is adjustably reduced. When the control bars 12,16 are moved sufficiently close together such that no material from within the bag 22 is being discharged, the neck of the bag 22 is sufficiently gathered so that the neck may be easily tied. This prevents discharge from the bag 22 upon subsequent movement of the control bars 12,16 away from each other and disengaging the neck of the bag 22.

Figure 3:
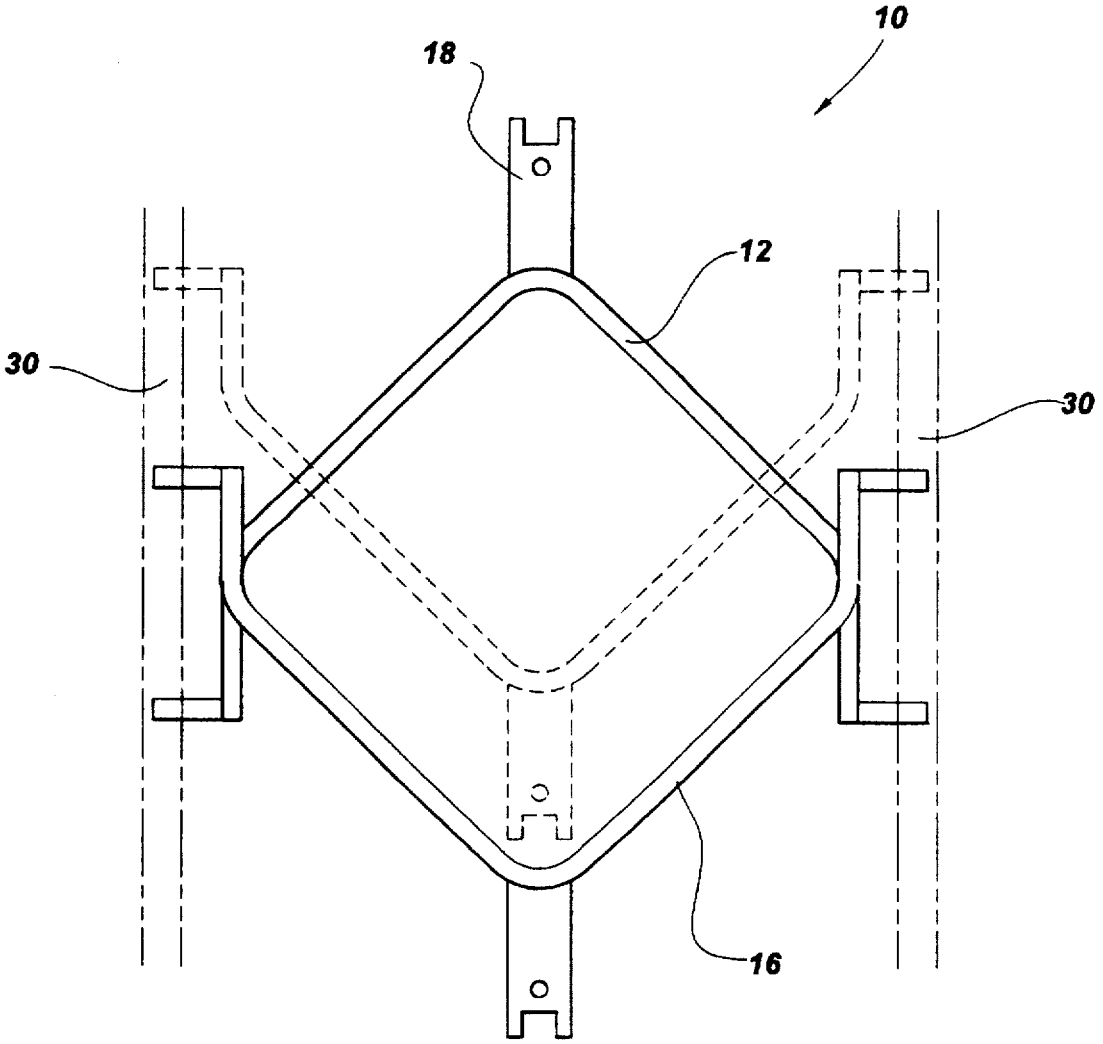
FIG. 3 is a plan view of the bag discharge constriction apparatus of FIG. 1, illustrating the arrangement of the apparatus before and after movement of a control bar.

As can be seen in FIG. 3, the predetermined shape of the opening 20 is maintained at all times, and it changes only in size as the control bars 12,16 are moved toward or away from each other. The angular relationships 14 and the opening 20 defined therebetween allow greater control of the discharge of material from the bag 22 than the prior art use of converging and diverging parallel bars. Further, when the control bars 12,16 are sufficiently converged to stop all discharge of material, the neck of the bag 22 is sufficiently gathered to allow easy retying of the neck to seal the bag 22. This is not possible with the prior art devices.

Because the opening 20 changes only in size, the stresses that are placed on the neck of the bag 22 are much more evenly distributed than in the use of the parallel bars of the prior art and this arrangement and method result in significantly less tearing stresses applied to the bag 22. Thus, there are fewer failures of bags 22 from which discharge of material is to be controlled.

Figure 5:
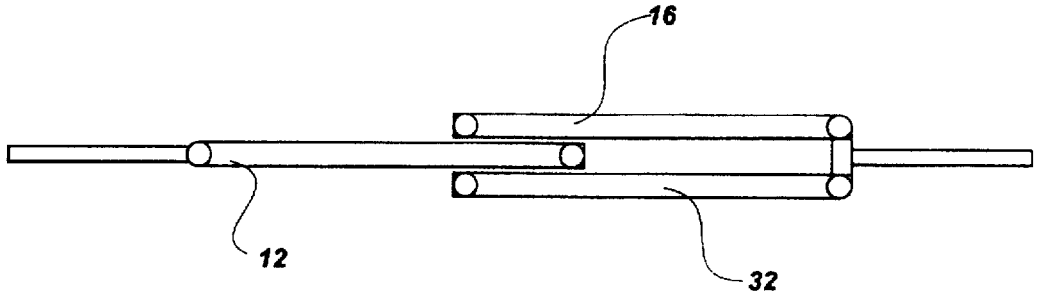
FIG. 5 is a side view of the bag discharge constriction apparatus of FIG. 4.

FIG. 4 illustrates another embodiment of the present invention, wherein a third control bar 32 identical in shape to control bars 12,16 lies in a third plane disposed essentially parallel to the planes in which the first control bar 12 and the second control bar 16 lie, and is mounted on a support 33 for movement with the second control bar 16. The third control bar 32 is disposed in a spaced, coextensive relationship with the second control bar 16, with the first control bar 12 disposed between the second control bar 16 and the third control bar 32 as illustrated in FIGS. 4 and 5.

In this embodiment, the third control bar 32 has guide pins 28 attached thereto in the same manner as the first control bar 12 and the second control bar 16, and the guide bars 30 have an additional slot 31 to receive the guide pins 28 attached to the third control bar 32. Thus, the third control bar 32 moves with second control bar 16 and is controlled in the same manner and direction as is the movement of the first control bar 12 and the second control bar 16.

With this configuration, when the neck of the bag 22 is placed into the opening 20 and the control bars 16,32 move toward control bar 12, control bars 16,32 engage the neck of the bag 22 above and below the point of engagement of the first control bar 12. In this way, the apparatus 10 more effectively stops the flow of material from within the bag 22 because the neck of the back is confined more securely by the three control bars 12,16,32.

Figure 7:
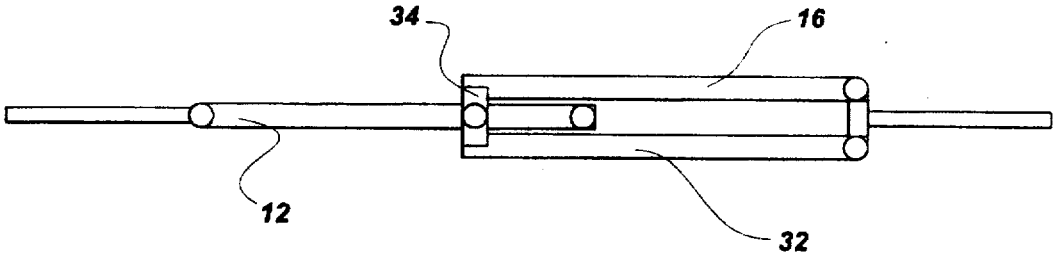
FIG. 7 is a side view of the bag discharge constriction apparatus FIG. 6.
Figure 8:
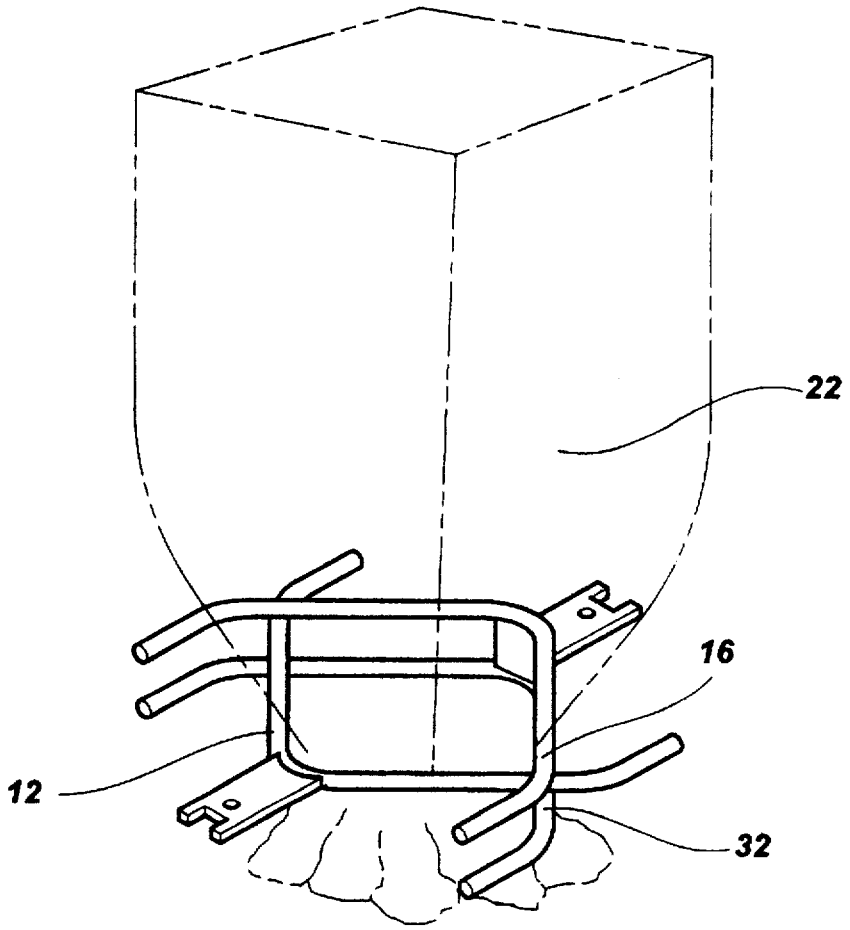
FIG. 8 is a perspective view of the bag discharge constriction apparatus and illustrating the placement of a bag from which the discharge of material is to be controlled.

In another embodiment of the present invention, illustrated in FIGS. 6 and 7, the bag discharge constriction apparatus 10 includes the same three control bars 12,16,32 as described above, but in this embodiment a bracket 34 connects the second control bar 16 and the third control bar 32 near the ends of the bar segments 26 and guide pins 28 are attached approximately midway between the second control bar 16 and the third control bar 32 on the brackets 34 so as to extend essentially perpendicularly to and outwardly from the bar segments 26 and in substantially the same plane of movement as the first control bar 12 whereby both said guide pins at each side can move in a single slot 31 on the guide bar 30, thus necessitating fewer slots 31 in the guide bars 30. When the control bars are moved away from each other a predetermined distance, either the guide pins 28 of the first control bar 12 contact the bracket guide pins 28, or the guide pins 28 of the first control bar 12 contact the brackets 34, and prevent further divergent movement of the control bars.

It has been found that the shape, thickness, and spacing of the control bars 12,16, and, if present, the third control bar 32, should be selected so as to provide efficient functioning of the bag discharge constriction apparatus. Note that if the first control bar 12 is spaced too far above or below the second control bar 16, then, when the guidance device 24 operates to move the control bars 12,16 closer to each other in their respective planes, the neck of the bag 22 may not be efficiently constricted and the result will be continued discharge of the material through a convoluted path within the neck, with the aperture in the neck of the bag being displaced from its desired position. The control bars 12,16 would then effect only a redirection of the material being discharged from the bag, instead of controlling the amount of material discharged from the bag and may also move such aperture sufficiently to alter the location to which the material is ultimately discharged. On the other hand, if the first control bar 12 and the second control bar 16 are too close together, the result may be a pinching of the neck of the bag 22, placing additional tearing stresses upon the bag 22.

If the control bars 12,16,32 are shaped such that an edge, corner, or other sharp surface is presented to contact the bag 22, then the tearing stresses on the bag 22 are increased and the bag 22 is more likely to fail. Also, any control bar shape other than essentially round may impart uneven stresses on the bag during the convergent and divergent movement of the control bars and may lessen the effectiveness of the seal of the bag 22 when the control bars are converged.

Preferably, the control bars 12,16 are essentially round and have a diameter of about 16 millimeters. The spacing between the control bars is preferably about 4 millimeters. If the third control bar 32 is present, it, too, is essentially round, having a diameter of about 16 millimeters, with a spacing from the first bar of about 4 millimeters.

The aforesaid drive arrangement attached to brackets 18 to provide movement of the control bars 12,16,32 may be of any conventional means, such as a pneumatic actuator. It is to be recognized also that the length of the control bars 12,16,32, the bar segments 26 attached thereto, and the guide pins 28 attached to the bar segments 26 may be varied to suit the particular circumstances and needs of the configuration desired without departing from the spirit of the invention. It is also to be recognized that the guide bars 30 may be of any configuration, so long as the slots 31 formed in the guide bars 30 are configured to enable the guide pins 28 to slide therein and limit the movement of the control bars 12,16,32 to the planes in which they lie.

The material of construction of the control bars 12,16,32, the bar segments 26, the guide pins 28, and the guide bars 30 is not a limiting feature of this invention and does not affect its novelty. Any suitable material may be used in the construction, and it will be recognized by one skilled in the art that a wide variety of materials are available. Also, it will be noted that it may be advantageous to construct each control bar and the corresponding bar segments and guide pins from a single piece of material, such as metal. This may reduce construction costs and possibly extend the life of the apparatus.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A bag discharge constriction apparatus for adjustably varying the extent to which an opening in a bag is constricted to control the discharge of material from said bag, comprising:

(a) a first control bar defining at least one angular relationship in a first plane, (b) a second control bar defining at least one angular relationship in a second plane, and (c) means for moving at least one control bar in its associated plane toward and away from the other control bar and stopping the movement of the one control bar at any one of a plurality of different positions relative to the other control bar, wherein the first plane and the second plane are disposed in spaced, generally parallel relation to one another, the first control bar and the second control bar cooperate to establish an opening therebetween having a predetermined confined shape into which the neck of a bag to be constricted is placed, and the control bars are supported such that the confined shape does not change as the control bars are moved and stopped closer to or farther from each other in their respective planes to vary the area of the confined shape at each of the plurality of different positions, whereby the movement of the control bars toward and away from each other changes the opening in the bag evenly from all sides and minimizes tearing stresses.

2. The apparatus of claim 1, wherein guidance means are associated with said control bars to control the movement of the control bars so that they move essentially within the planes in which the control bars are located.

3. The apparatus of claim 2, wherein each of the first and second control bars include two extending bar segments disposed to extend in a direction essentially parallel to the direction of movement of the control bar, each said bar segment at one said extending end being in a substantially parallel relation to the bar segment at the other said extending end of the control bar and in substantially the same plane as the control bar to which the bar segment is joined.

4. The apparatus of claim 3, wherein the guidance means includes:

(a) a guide pin attached near the end of each bar segment and disposed to extend substantially perpendicularly outwardly from the bar segment in substantially the same plane as the control bar to which the bar segment and guide pin are attached; and (b) two guide bars disposed exteriorly of the first and second control bars on opposite sides thereof and substantially parallel to each other, said guide bars being formed with slots therein with the guide pins on the first control bar segment and the guide pins on the second control bar segment disposed in said slots such that the movement of the first control bar and the second control bar is substantially confined to the planes within which the control bars lie.

5. The apparatus of claim 1, wherein the diameter of each control bar is about 16 millimeters.

6. The apparatus of claim 1, wherein the space between the control bars is about 4 millimeters.

7. The apparatus of claim 1, wherein the predetermined shape is a rectangle.

8. The apparatus of claim 1, wherein the angled relationships are such that, when the first control bar and the second control bar are moved in relation to one another, the overlapping of the angled relationship of the first control bar with the angled relationship of the second control bar at all times forms a rectangle when viewed from a direction substantially perpendicular to the planes in which the first control bar and second control bar lie.

9. The apparatus of claim 1, wherein, when the first control bar and the second control bar are moved toward one another to close the neck of the bag and to fully cease the discharge of material therefrom and to sufficiently gather the neck to enable tying of the neck to prevent discharge therefrom after the first control bar and the second control bar are subsequently caused to move in opposite directions.

10. The apparatus of claim 1, wherein a third control bar defines at least one angular relationship in a third plane that is disposed essentially parallel to the first and second planes, said third control bar being in a spaced, parallel relationship with the second control bar.

11. The apparatus of claim 10, wherein the first control bar is disposed between and opposed to the second control bar and the third control bar.

12. The apparatus of claim 11, wherein guidance means is provided to control the movement of the control bars to be essentially within the planes in which the control bars are located.

13. The apparatus of claim 12, wherein a bar segment is joined to an extending end of each control bar and is disposed to extend in a direction away from the extending end of the control bar that is essentially parallel to the direction of movement of the control bar, said bar segment being disposed in a substantially parallel relation to the bar segment at the other extending end of the control bar and in substantially the same plane as the control bar to which the bar segment is joined.

14. The apparatus of claim 13, wherein the guidance means comprises:

(a) a guide pin attached near the end of each bar segment and disposed to extend substantially perpendicularly outwardly from the bar segment in substantially the same plane as the control bar to which the bar segment and guide pin are attached; and (b) two guide bars disposed exteriorly of the control bars on opposite sides thereof and substantially parallel to each other, said guide bars being formed with slots therein, with the guide pins disposed in said slots such that the movement of the control bars is substantially confined to the planes within which the control bars lie.

15. The apparatus of claim 13, wherein the guidance means comprises:

(a) a guide pin attached near each end of the bar segment on the first control bar and disposed to extend substantially perpendicularly outwardly from the bar segment in substantially the same plane as the first control bar;

(b) a bracket connecting each bar segment on the second control bar with the corresponding proximate bar segment on the third control bar;

(c) a guide pin attached to each bracket approximately midway between the second and the third control bars and disposed to extend outwardly substantially perpendicularly from the bracket and substantially parallel to the control bar planes, such that the bracket guide pins are in substantially the same plane of movement as the first control bar guide pins; and (d) two guide bars disposed exteriorly of the control bars on opposite sides thereof and substantially parallel to each other, said guide bars being formed with a slot therein, with the guide pins disposed in said slot such that the movement of the control bars is substantially confined to the planes parallel to those in which the control bars lie.

16. The apparatus of claim 15, wherein the first control bar guide pins and the bracket guide pins are arranged such that when the control bars are moved away from each other, the first control bar guide pins contact the brackets and prevent further divergent movement of the control bars.

17. The apparatus of claim 15, wherein the first control bar guide pins and the bracket guide pins are arranged such that when the control bars are moved away from each other, the first control bar guide pins contact the bracket guide pins and prevent further divergent movement of the control bars.

18. The apparatus of claim 11, wherein the space between each of the control bars is about 4 millimeters.

19. The apparatus of claim 1, wherein the control bars are essentially round.

20. A method of controlling the constriction of the neck of a discharge bag, comprising the steps of:

(a) providing at least two opposed members, each defining at least one angular relationship;

(b) locating said opposed members so that said angular relationships define a predetermined confined shape therebetween;

(c) placing the neck of the discharge bag between the opposed members and within the predetermined confined shape;

(d) causing said members to engage the neck of the discharge bag within the predetermined shape therebetween and to move toward and away from each other; and (e) maintaining the predetermined confined shape between the opposed members while changing the confined area thereof during said movement of the opposed members, whereby said movement of the members towards each other constricts the opening to restrict the discharge of material from within the bag and gathers the neck in such a way that the neck may be easily tied, and movement of said members away from each other allows the opening to enlarge such that material from within the bag is discharged more freely, said engagement of the neck within the predetermined shape minimizing tearing stresses placed on the bag by the opposed members.

21. The method of claim 20, further comprising the step of guiding the movement of the control bars such that the spacing between the planes of movement of the control bars remains essentially constant throughout the entire movement path.

* * * * *